US006530324B1

(12) United States Patent
Steele et al.

(10) Patent No.: US 6,530,324 B1
(45) Date of Patent: Mar. 11, 2003

(54) FUZE MECHANISM FOR A MUNITION

(75) Inventors: Michael F. Steele, Cincinnati, OH (US); William Marc Schmidt, Batavia, OH (US)

(73) Assignee: KDI Precision Products, Inc., Cincinnati, OH (US)

( * ) Notice: Subject to any disclaimer, the term of this patent is extended or adjusted under 35 U.S.C. 154(b) by 0 days.

(21) Appl. No.: 09/880,478

(22) Filed: Jun. 13, 2001

(51) Int. Cl.[7] ..... F42C 15/34

(52) U.S. Cl. ..... 102/254; 102/254; 102/251; 102/244; 102/235; 102/229

(58) Field of Search ..... 102/254, 256, 102/259, 251, 226, 487, 235, 339, 230, 221, 229, 253, 244

(56) References Cited

U.S. PATENT DOCUMENTS

| | | | | | |
|---|---|---|---|---|---|
| 3,913,483 | A | * | 10/1975 | Wolterman | 102/226 |
| 3,926,122 | A | * | 12/1975 | Wolterman | 102/226 |
| 3,998,164 | A | * | 12/1976 | Hadfield | 102/226 |
| 4,253,375 | A | * | 3/1981 | Field | |
| 4,430,938 | A | * | 2/1984 | Jander | 102/235 |
| 4,455,940 | A | * | 6/1984 | Furuike | 102/230 |
| H136 | H | * | 10/1986 | Field | 102/487 |
| 4,632,033 | A | * | 12/1986 | Gordon et al. | 102/239 |
| 4,662,278 | A | * | 5/1987 | Lillios | 102/244 |
| 4,777,879 | A | * | 10/1988 | Bueno et al. | 102/226 |
| 4,852,496 | A | * | 8/1989 | Campagnuolo et al. | |
| 4,982,663 | A | * | 1/1991 | Scheve et al. | 102/251 |
| 5,686,692 | A | | 11/1997 | Watson, Jr. | 102/352 |
| 5,932,834 | A | * | 8/1999 | Lyon et al. | 102/226 |
| 6,082,267 | A | | 7/2000 | Cooper | 102/487 |
| 6,272,995 | B1 | | 8/2001 | Schmidt et al. | 102/209 |
| 6,302,025 | B1 | | 10/2001 | Adimari et al. | 102/254 |
| 6,336,407 | B1 | * | 1/2002 | Adimari et al. | 102/259 |

FOREIGN PATENT DOCUMENTS

| | | | | |
|---|---|---|---|---|
| DE | 0379142 A2 | * | 7/1990 | 102/254 |
| FR | 2672673 | * | 8/1992 | 102/254 |

* cited by examiner

*Primary Examiner*—Michael J. Carone
*Assistant Examiner*—Lulit Semunegus
(74) *Attorney, Agent, or Firm*—Harness, Dickey & Pierce, PLC

(57) ABSTRACT

A munition incorporating a fuze mechanism adapted to prevent momentary disarming of the mechanism once same is placed in an armed state. The fuze mechanism incorporates a fuze housing having a slide member movable slidably longitudinally between an unarmed position and an armed position. In an unarmed position, a firing pin tip of an arming screw engages a lock post disposed within an opening in the slide member to hold the slide member in the unarmed position. When the arming screw is unscrewed during airborne deployment of the munition, the firing pin tip is withdrawn from the lock post. This enables a spring to urge the slide member into a laterally extended position. As the slide member moves into its laterally extended position, the lock post drops partially out of the slide member into abutting engagement with a bottom cover of the fuze mechanism, thus preventing the slide member from moving back towards its unarmed position. Thus, the lock post prevents momentary movement of the slide member back towards its unarmed position regardless of the orientation at which the munition strikes the ground surface or a target, thus eliminating the possibility of undetonated yet armed munitions remaining on a ground surface or target.

10 Claims, 5 Drawing Sheets

FUZE MECHANISM FOR A MUNITION

BACKGROUND OF THE INVENTION

1. Technical Field

This invention relates to munitions, and more particularly to a fuze for a munitions such as a grenades adapted to be deployed from mortars, artillery and rockets, and more specifically to a fuze mechanism having a construction adapted to ensure detonation once the mechanism is armed.

2. Discussion

Fuze mechanisms are used in a variety of military applications in connection with grenades deployed from mortars, artillery and rockets. A typical arming mechanism for such a grenade is shown in FIGS. 1 and 2. This arming mechanism of the fuze 10 includes a fuze housing 11 having an arming screw 12. The fuze housing 11 is secured to a grenade 32. The arming screw 12 has a threaded portion 14, which is engaged with a threaded opening 16*a* in an inertia weight 16. When in the unarmed state shown in FIG. 1, the firing pin tip 18 of the arming screw 12 rests within a bore 20 formed within a slide member 22. The slide member 22 is biased by a biasing spring 24 to the right in the direction of the drawing of FIG. 1. In the unarmed state, the firing pin tip 18 of the arming screw 12 located inside the bore 20 of the slide member 22 holds the slide member 22 in the unarmed and safe position shown in FIG. 1. Thus, the firing pin tip 18 is not able to engage a stab detonator 26 disposed in a recess 26*a* at the left end of the slide member 22 shown in FIG. 1, until the arming action of unthreading the arming screw threads 14 and the weight threads 16*a* occurs.

When the grenade is deployed, such as through a mortar shell, an artillery shell or a rocket payload, as the grenade falls to Earth, a drag ribbon 30 secured to the arming screw 12 unfurls and begins to vibrate and rotate. These drag induced dynamic movements of the drag ribbon 30 unthread the arming screw threads 14 from the weight threads 16*a* such that the firing pin tip 18 is withdrawn from the bore 20 in the slide member 22. The said movements are illustrated in FIG. 3. Upon release, the slide member 22 is urged to the right by the biasing force of the biasing spring 24, as also shown in the drawing of FIG. 3. This motion aligns the stab detonator 26 with the firing pin tip 18 of the arming screw 12. In addition to initiating the arming mechanism, the unfurled drag ribbon 30 also orients the grenade 32 during the grenade 32 descent phase of the deployed cargo flight. During deployed flight, the drag ribbon 30, lifts upward on the grenade 32 causing the grenade base 32*a* to be aimed at the surface of the ground 36 or target. When the base 32*a* of the grenade 32 strikes the ground surface 36 with the slide member 22 in the deployed and armed position, the inertial motions of the combination of the weight 16 and the arming screw 12 cause the arming screw 12 firing pin tip 18 to be driven into the stab detonator 26, thereby initiating the stab detonator 26 and functioning the grenade 32.

Owing to in flight oscillations of the drag ribbon 30 and the grenade 32 combined with irregularities in the ground surface 36, the grenade 32 may impact the ground surface 36 in a plurality of attitudes. It has been recently discovered that for a discrete population of the family of impacts, that the arming and firing mechanism is subject to failure. The fault mechanism and envelope can be characterized in the drawings of FIGS. 3 and 4. When the grenade base 32*a* of the grenade 32 contacts the ground surface 36 or target at small angles, as shown in FIG. 4, the fuze 10 can be momentarily disarmed. More specifically, if the grenade body 32 lands at an angle defined by "α", as indicated in FIG. 4, an upper surface 32*b* of the grenade 32 moves in one direction, in this example to the right (indicated by arrow 27) as the grenade 32 rotates about the contact point between the grenade base 32*a* and the ground surface 36, while the slide member 22 moves in the opposite direction or to the left as also shown in the illustration of FIG. 4.

This phenomena is a function of the spatial positioning between the ground 36 or target contact point, the grenade 32 center of gravity position at impact and the ability of the slide member 22 to move linearly relative to the fuze housing 11 and the top surface 32*b* of the grenade 32. The vertical plane for the specified performance fault illustrated in FIG. 4 thus lies between near zero degrees and α degrees, where α is the angle between the base 32*a* of the grenade 32 and a flat ground surface 36 which is perpendicular to the earth's gravity vector as represented by the line 40 shown in FIG. 4. The fault envelope in the horizontal plane, as shown in FIG. 5, is zero degrees +/−"β" degrees, where β is the angle between the highest point on the grenade upper surface 32*b* when the grenade 32 is oriented at some angle α, from the ground surface 36 or target, and the longitudinal axis 34 of the slide member 22, and more specifically where the slide member 22, once deployed, is directed upward and away from the grenade base 32*a* impact point on the ground surface 36 or target surface.

When the grenade base 32*a* strikes the ground 36 or target surface at an angle α and the slide member 22 is positioned within the angle β on either side of the longitudinal axis 34, as defined in FIG. 5, the top surface 32*b* of the grenade 32 and the bottom surface 22*a* of the slide member 22 move in opposite directions. More specifically, in the drawing of FIG. 4, the top surface 32*b* of the grenade body 32 moves to the right while the slide 22 momentarily overcomes the biasing force of the biasing spring 24 and moves to the left. The relative motion between the top surface 32*b* of the grenade 32 and the slide member 22 causes the stab detonator 26 to be momentarily moved out of axial alignment with the firing pin 18 as the firing pin 18 is carried down toward the slide member 22 by the inertia of the arming screw 12 and weight 14. This momentary misalignment of the stab detonator 26 with the firing pin tip 18 of the arming screw 12 prevents the firing pin tip 18 from striking the stab detonator 26 or causes the firing pin tip 18 to strike the stab detonator 26 outside of its percussion sensitivity envelope, thus preventing initiation of the stab detonator 26 and detonation of the grenade 32. Finally, after dissipation of the relative velocities between the bottom of the slide member 22*a* and the top surface of the grenade 32*b* which had arisen from the instantaneous contact of the grenade 32 with the target or ground surface 36, the biasing force of the biasing spring 24 again causes the slide member 22 to be urged into its fully extended position shown in FIGS. 3 and 4. In this position the fuze 10 remains in an armed state, thus leaving the grenade 32 in a highly dangerous condition where external grenade 32 contact or vibration can cause the armed firing pin tip 18 to contact and initiate the stab detonator 26, thereby involuntarily functioning the grenade 32.

It is known, that in tactical maneuvers, large numbers of munitions incorporating a fuze mechanism 10 of the type illustrated in FIGS. 1–5 are not detonated upon impact with a ground surface 36 or target due to the orientation at which the grenade 32 impacts the ground surface 36 or target. It is therefore a principal object of the present invention to provide an arming mechanism for a munition, such as a grenade 32, which is not susceptible to spurious anomalies caused by the orientation at which the munition impacts a ground surface 36 or target when deployed.

It is still a further object of the present invention to provide an arming mechanism for a munition that incorporates a means to maintain the fuze mechanism in an armed state once the mechanism assumes an armed condition, regardless of the orientation or attitude of its associated grenade 32 when the grenade 32 impacts a ground surface 36 or target.

SUMMARY OF THE INVENTION

The above and other objects are provided by a fuze mechanism for a munition in accordance with the preferred embodiments of the present invention. In one preferred embodiment the fuze mechanism incorporates a fuze housing having an arming screw including a firing pin disposed therein. The firing pin engages within a bore in a slide member when the fuze is in an unarmed state.

The firing pin is moved out of engagement with the slide member during deployment of a munition as the arming screw is unthreaded from an internal component of the fuze mechanism. Once this occurs a biasing member urges the slide member laterally outwardly of the housing. Once the slide member moves to a fully extended position, a lock post carried in a bore formed in the slide member is partially released from the bore. In the partially released position, the lock post abuts an internal surface within the fuze housing to prevent the slide member from being urged momentarily out of the armed position should the munition contact a ground surface or target at an angle which would otherwise result in momentary disarming of the fuze mechanism.

The lock post does not add significantly to the cost of the fuze mechanism nor does it significantly complicate the construction or assembly of the mechanism. Instead, the lock post ensures that, once armed, the fuze mechanism remains armed regardless of the orientation at which the munition associated with the fuze mechanism strikes the ground surface or target.

Explosive Ordnance Personnel require deployed and armed fuzes to be rendered safe for handling and disposal. The unique design of the lock post allows for its manual defeat by inverting the fuze and grenade, and then overriding the slide member biasing spring to the extent required to release the lock post, thus allowing the lock post to return to its original position in the slide member bore. With the lock post stowed in the slide member, the slide member can be returned to its safe position within the housing by compressing the biasing spring. The slide member may be secured in the safe position by re-threading the arming screw and weight, thus inserting the firing pin tip of the arming screw into the bore in the locking post to impede motion of the slide member in the deployed

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
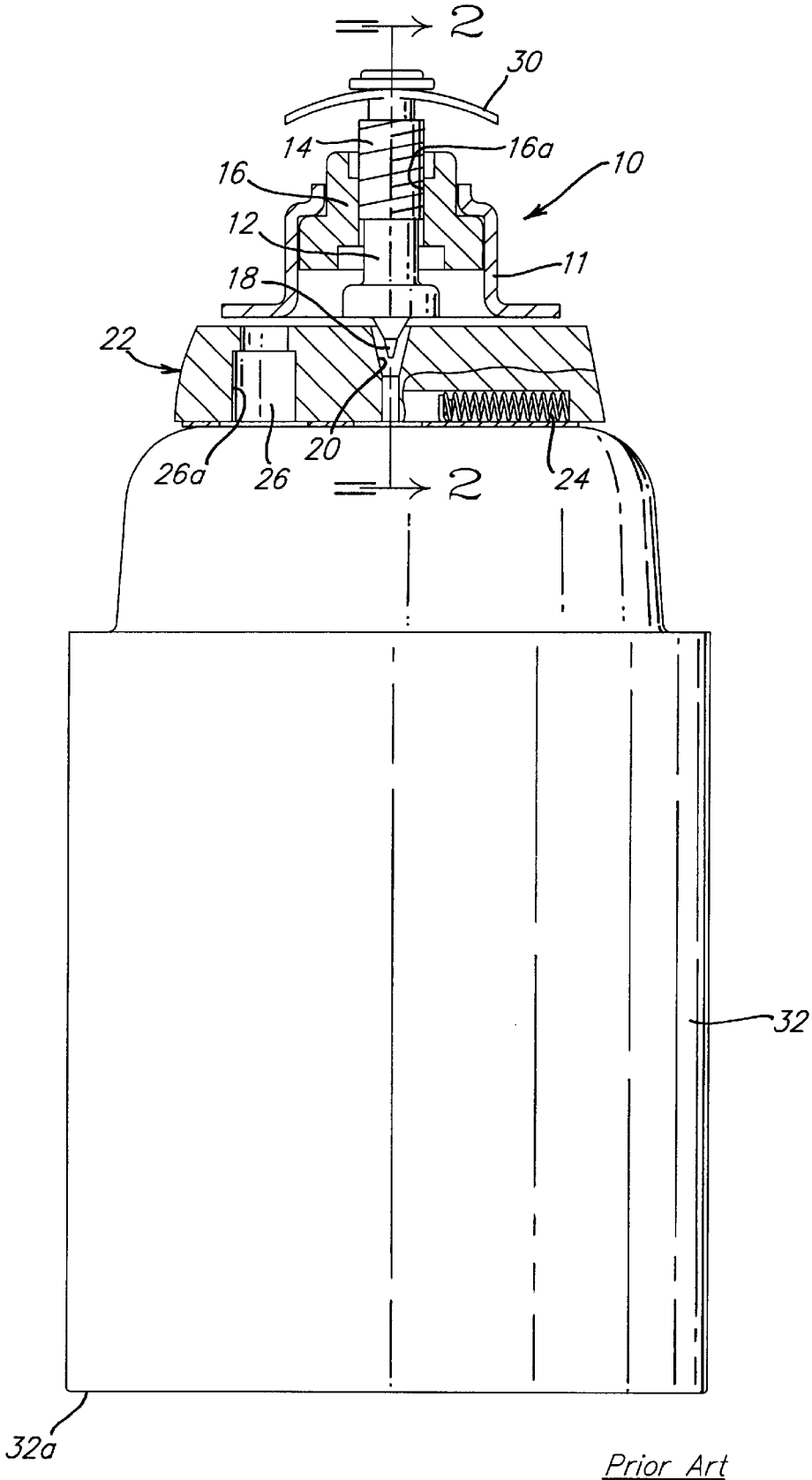
Prior Art FIG. 1.
FIG. 1 is a side cross sectional view of a prior art fuze mechanism secured to a grenade body.
Figure 2:
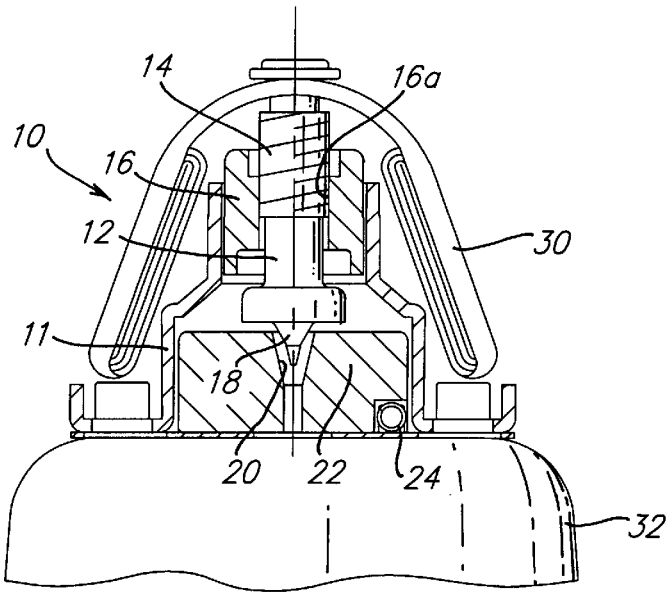
Prior Art FIG. 2.
FIG. 2 is a cross sectional end view of the fuze mechanism of FIG. 1 taken in accordance with section line 2—2 in FIG. 1.
Figure 3:
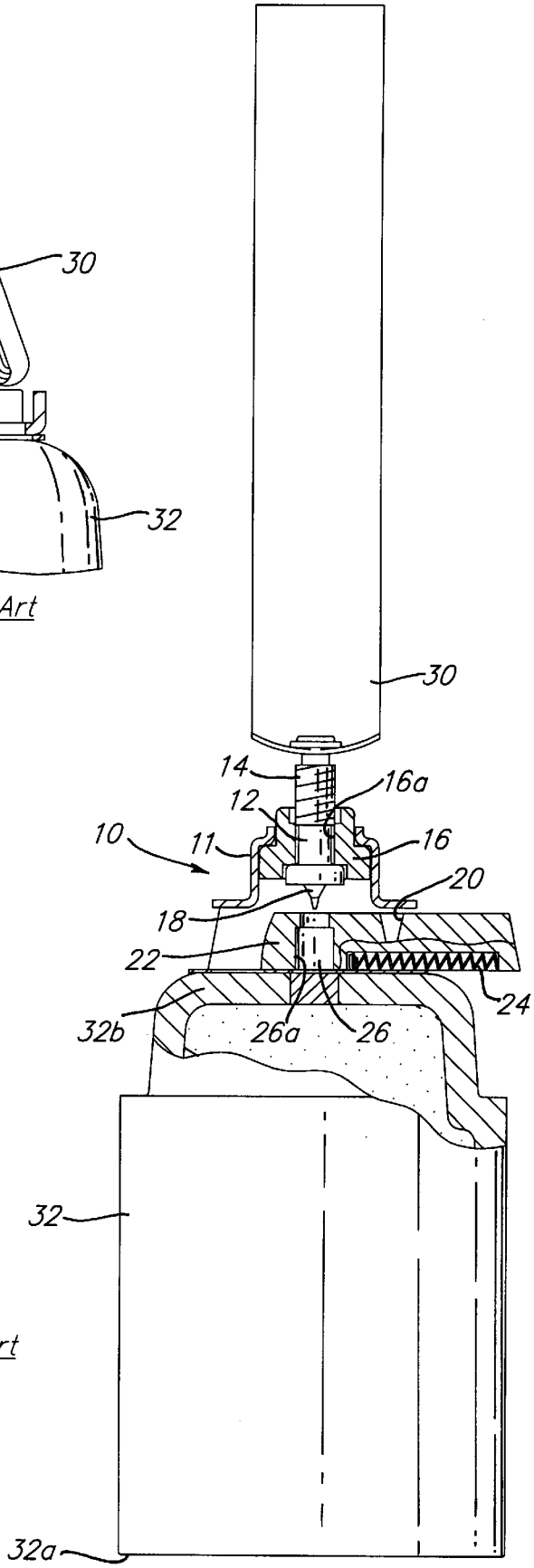
Prior Art FIG. 3.
FIG. 3 is a partial side cross-sectional view of the fuze mechanism of FIG. 1 illustrating the mechanism in an armed state.
Figure 5:
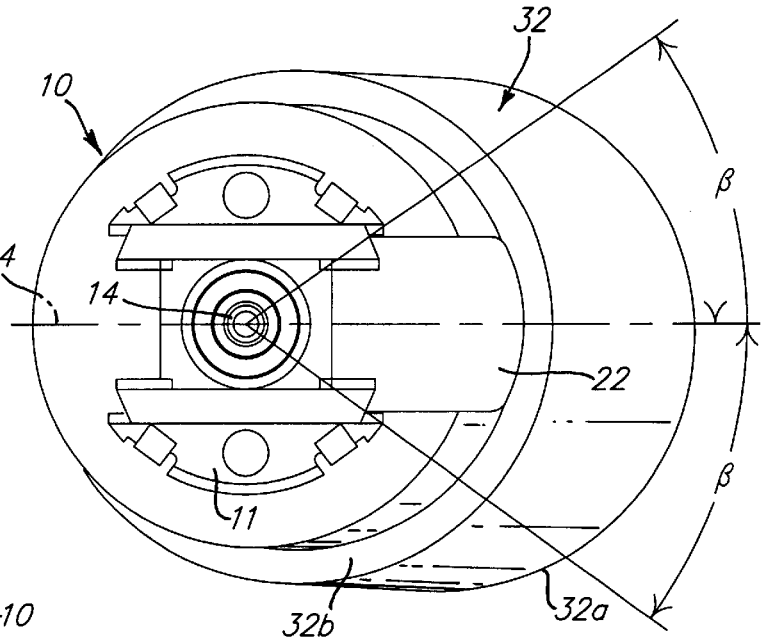
Prior Art FIG. 5.
FIG. 5 is a top view of the fuze mechanism and its grenade body landing at an angle non-parallel to a ground surface illustrating the error envelope, represented by β, within which unintended, momentary disarming of the fuze mechanism may occur should the grenade strike the ground surface or a target within the angles defined by +/−β.
Figure 4:
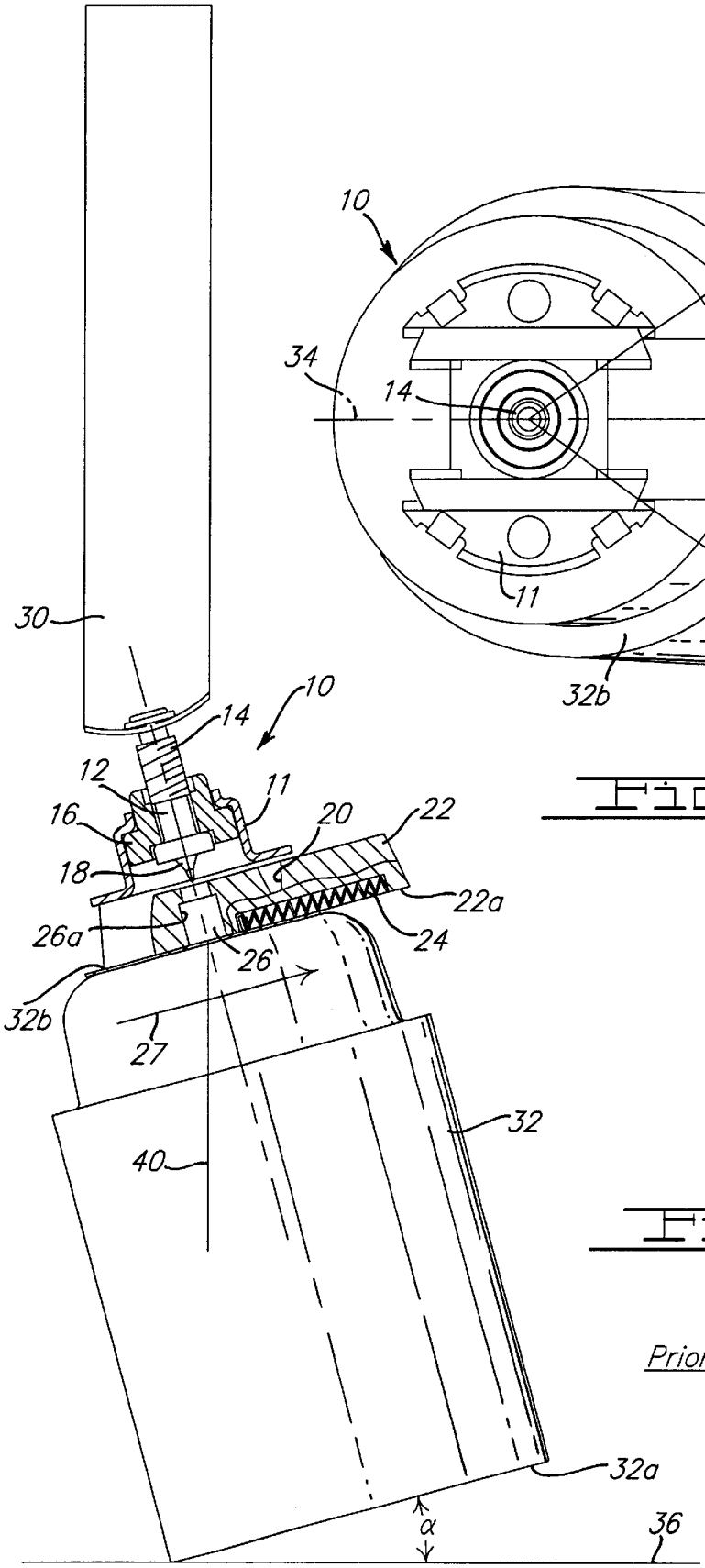
FIG. 4. Prior Art
FIG. 4 is a side view of the fuze mechanism and grenade of FIG. 1 impacting a ground surface at an angle a which causes momentary disarming of the previously armed fuze mechanism.
Figure 6:
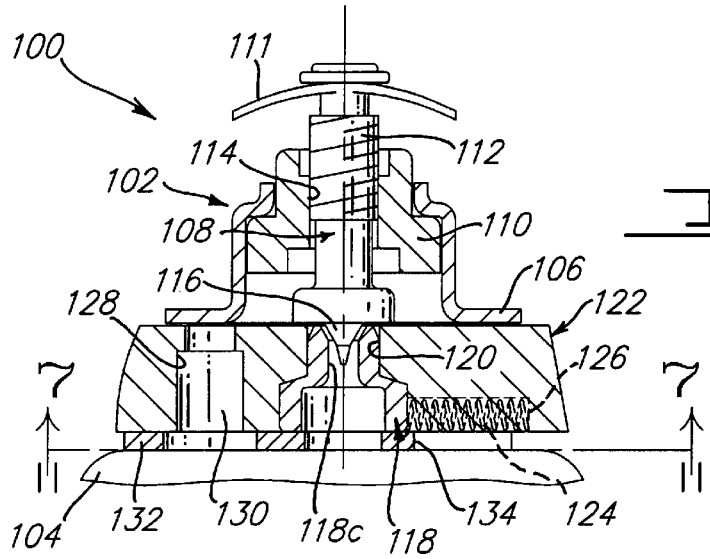
FIG. 6 is a cross-sectional side view of a fuze mechanism in accordance with a preferred embodiment of the present invention, showing the fuze mechanism in an unarmed state.
Figure 7:
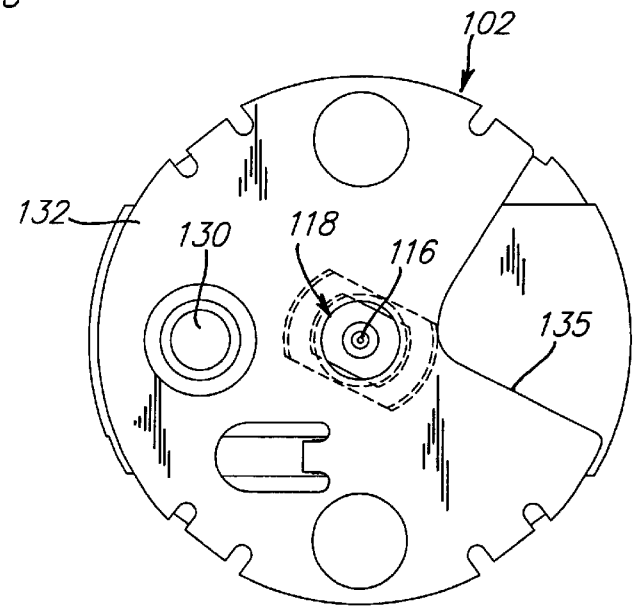
FIG. 7 is a bottom view of the fuze mechanism of FIG. 6 in accordance with directional line 7—7 in FIG. 6.

Referring to FIGS. 6 and 7, a munition 100 incorporating a fuze mechanism 102 is illustrated. The fuze mechanism 102 is secured to a grenade body or other explosive implement 104. The fuze mechanism 102 is similar to the fuze mechanism 10 of FIG. 1 in that the mechanism 102 also includes a fuze housing 106 within which is disposed an arming screw 108 and an inertia weight 110. The arming screw 108 includes a threaded portion 112 which is engaged in a threaded opening 114 in the weight 110. A drag ribbon 111 is secured to an upper end of the arming screw 108.

The arming screw 108 includes a firing pin tip portion 116 which is aligned with a bore 118*c* in a lock post 118 when the fuze mechanism 102 is in its unarmed or safe state. The lock post 118 resides within an opening or a bore 120 formed in a slide member 122. A biasing member 124 (shown in phantom) resides within a cavity or recess 126 in the slide member 122. The slide member 122 also includes a recess 128 which houses a stab detonator 130. The slide is mounted for longitudinal movement along between a housing 106 and a bottom cover 132. A tab 134 formed from the bottom cover 132 forms a surface against which one end of the biasing spring 124 abuts.

With specific reference to FIG. 7, the bottom cover 132 includes a slot 135 formed longitudinally in line with the axis of movement of the slide member 122. The slot 135 is wider than the width of the lock post 118 such that the lock post 118 is able to drop into the slot 135 when the slide member 122 is moved from the safe or stowed position to an armed position.

Figure 10:
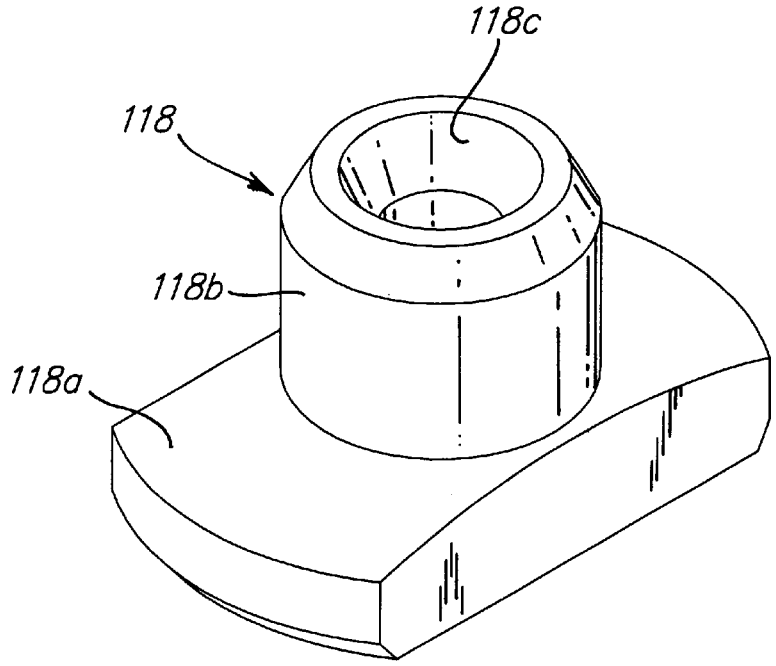
FIG. 10 is a perspective view of the lock post.

Referring to FIG. 10, the lock post 118 is shown in greater detail. The lock post includes a base portion 118*a,* a neck portion 118*b* and a bore 118*c* within which the firing pin tip 116 of the arming screw 108 engages when the slide member 122 is in its unarmed or safe position. The lock post 118 may be formed from any structurally suitable material such as steel, brass or aluminum.

Figure 8:
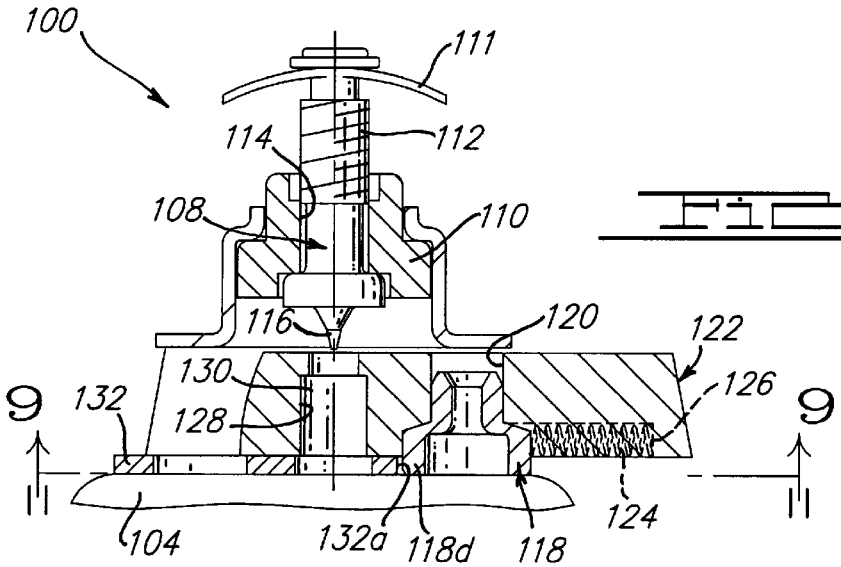
FIG. 8 is a side cross sectional view showing the fuze mechanism of FIG. 6 in an armed condition.

Referring now to FIG. 8, during deployment of the munition 100, the drag ribbon 111 encounters vibratory and spinning motions as the munition 100 falls toward the ground or a target. This dynamic drag ribbon 111 movement unscrews the threaded portion 112 of the arming screw 108 from the weight 110, thus causing the entire firing pin tip 116 to be withdrawn from the lock post 118. As soon as this occurs, the biasing spring 124 immediately urges the slide member 122 to the right in the drawing of FIG. 8. As the slide member 122 reaches its rightmost fully extended position shown in FIG. 8, the lock post 118 drops into the slot 135 in the bottom cover 132. In this position the stab detonator 130 is now aligned with the longitudinal axis of the firing pin tip 116 of the arming screw 108. The engagement of the lock post 118 within the slot 135 is shown in FIG. 9.

Figure 9:
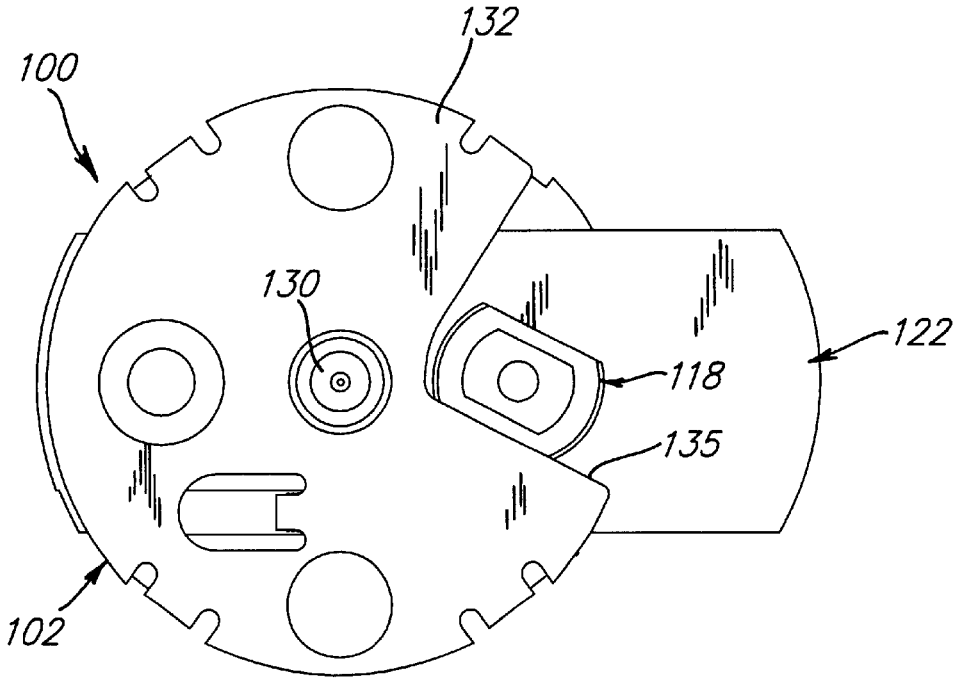
FIG. 9 is a bottom view of the fuze mechanism of FIG. 8 in the armed state.

As can be seen in FIGS. 8 and 9, a bottom edge 118*d* of the lock post 118 abuts an edge 132*a* of the bottom cover 132 to prevent the slide member 122 from again moving towards the left in the drawing of FIG. 8, thus preventing the stab detonator 130 from moving momentarily out of longitudinal alignment with the firing pin tip 116 of the arming screw 108. Thus, once the slide member 122 is moved into its armed position shown in FIG. 8, it will remain in this position regardless of the orientation with which the munition 100 impacts a ground surface or target.

The fuze mechanism 102 of the present invention thus eliminates the hazardous condition of armed but undetonated munitions being left on a ground surface by maintaining arming screw 108 firing pin tip 116 to stab detonator 130 alignment during the explosive initiation event occurring during the grenade 100 and ground surface or target impact. Importantly, the fuze mechanism 102 accomplishes this without significantly increasing the complexity and cost of the fuze mechanism, and without increasing the envelope of the fuze mechanism.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A fuze for a munition, comprising:

a fuze housing;

an arming screw having a firing pin tip moveable longitudinally within said fuze housing between an unarmed position and an armed position;

a first arming member adapted to operably engage with said firing pin tip such that said firing pin tip holds said first arming member in a first position when said arming screw is in said unarmed position, and moveable to a second position when said arming screw is moved into said armed position;

a biasing member for urging said first arming member toward said second position;

a second arming member operably associated with said first arming member and adapted to slide linearly from a non-locking position when said first arming member is in said first position, into a locking position as said first arming member is moved into said second position; and wherein in said locking position said second arming member prevents said first arming member from moving back toward said first position.

2. The fuze of claim 1, further comprising a drag ribbon secured to said arming screw; and wherein said arming screw is threadably engaged within a threaded opening in a component disposed within said fuze housing, said drag ribbon operating to unthread said arming screw from said threaded opening when said munition is in a free fall condition.

3. The fuze of claim 1, wherein said first arming member comprises a slide member adapted to move slidably longitudinally within said fuze housing once said arming screw is moved into said armed position.

4. The fuze of claim 3, wherein said slide member includes an opening; and wherein said second arming member comprises a lock post disposed within said opening; and wherein said lock post is able to move at least partially out of said opening when said slide member moves into said second position to abut a portion of said fuze housing, thereby preventing said slide member from moving back towards said first position.

5. A fuze for arming a munition, comprising:

a fuze housing;

an arming screw having a firing pin tip, said arming screw being moveable longitudinally within said fuze housing between an unarmed position and an armed position;

a slide member adapted to engage with a portion of said firing pin tip such that said firing pin tip holds said slide member in a first position when said arming screw is in said unarmed position, and moveable to a second position when said arming screw is moved into said armed position, said slide member including first and second bores formed therein;

a biasing member for urging said slide member toward said second position once said arming screw is moved into said armed position, said slide member placing said second bore in alignment with a detonation device and with a longitudinal axis of movement of said arming screw when said slide member is moved into said second position;

a lock member disposed within said first bore in said slide member and adapted to move from a non-locking position when said first arming member is in said first position, into a locking position protruding outwardly from said first bore when said first arming member is moved into said second position; and wherein in said locking position said lock member prevents said slide member from moving back toward said first position, thereby maintaining said second bore in alignment with said detonation device.

6. The fuze of claim 5, further comprising:

a drag ribbon secured to said firing pin for causing rotational movement of said arming screw after said munition is deployed above a ground surface and is falling to Earth;

wherein said arming screw comprises a threaded portion and said fuze housing comprises a component having a threaded opening within which said threaded portion of said arming screw is engaged; and said drag ribbon operating to cause rotational movement of said arming screw to unscrew said firing pin from said threaded opening as said munition falls to said Earth.

7. The fuze of claim 5, wherein said fuze housing includes a bottom wall; and wherein said slide member slides upon said bottom wall in moving between said first and second positions.

8. A fuze for arming a munition, comprising:

a fuze housing;

an arming screw having a firing pin tip disposed within said fuze housing, said arming screw being moveable longitudinally between an unarmed position and an armed position;

a slide member having a first portion disposed on a first face and engaged with said firing pin tip when said arming screw is in said unarmed position, said slide member being moveable slidably in a direction generally perpendicular to said longitudinal movement of said arming screw between a first position wherein said firing pin tip is engaged with said slide member, and a second position laterally displaced from said fuze housing when said arming screw is moved into said armed position;

a biasing member operably associated with said slide member for biasing said slide member into said second position as soon as said arming screw moves into said armed position; and a lock member operably associated with said slide member for engaging a surface that opposes a second face of said slide member oppositely disposed from said first face for holding said slide member in said second position as soon as said slide member moves into said second position, thereby maintaining said fuze in an armed state regardless of an orientation of said fuze when said fuze and its associated munition impacts a target.

9. The fuze of claim 8, wherein said slide member includes a bore that aligns with a longitudinal axis of said arming screw when said slide member is moved into said second position, said bore providing an unimpeded path to a detonation device disposed within said fuze.

10. The fuze of claim 8, further comprising:

a drag ribbon secured to said firing pin;

wherein said fuze includes a weight disposed within said fuze housing, said weight having a threaded opening;

wherein said arming screw includes a threaded portion which is engaged with said threaded opening; and wherein said drag ribbon operates to unthread said arming screw from said weight after said munition is deployed and is falling to Earth.

* * * * *